US010224630B2

(12) United States Patent
Iellci

(10) Patent No.: US 10,224,630 B2
(45) Date of Patent: Mar. 5, 2019

(54) MULTIBAND ANTENNA

(71) Applicant: MICROSOFT CORPORATION, Redmond, WA (US)

(72) Inventor: Devis Iellci, Cambridge (GB)

(73) Assignee: Microsoft Technology Licensing, LLC, Redmond, WA (US)

( * ) Notice: Subject to any disclaimer, the term of this patent is extended or adjusted under 35 U.S.C. 154(b) by 95 days.

(21) Appl. No.: 14/434,711

(22) PCT Filed: Oct. 11, 2013

(86) PCT No.: PCT/US2013/064715
§ 371 (c)(1),
(2) Date: Apr. 9, 2015

(87) PCT Pub. No.: WO2014/059382
PCT Pub. Date: Apr. 17, 2014

(65) Prior Publication Data

US 2015/0236417 A1 Aug. 20, 2015

(30) Foreign Application Priority Data

Oct. 11, 2012 (GB) ..... 1218286.1

(51) Int. Cl.
*H01Q 1/38* (2006.01)
*H01Q 5/328* (2015.01)
(Continued)

(52) U.S. Cl.
CPC ..... *H01Q 5/328* (2015.01); *H01Q 1/24* (2013.01); *H01Q 1/38* (2013.01); *H01Q 5/335* (2015.01); *H01Q 11/12* (2013.01)

(58) Field of Classification Search
CPC ..... H01Q 5/328; H01Q 5/335; H01Q 11/12; H01Q 1/24; H01Q 1/38
(Continued)

(56) References Cited

U.S. PATENT DOCUMENTS 5,867,126 A 2/1999 Kawahata et al.
7,978,141 B2 * 7/2011 Chi ..... H01Q 1/243 343/700 MS
(Continued)

FOREIGN PATENT DOCUMENTS

CN 201185228 Y 1/2009
CN 101432928 A 5/2009
(Continued)

OTHER PUBLICATIONS

"Office Action Issued in United Kingdom Patent Application No. 1218286.1", dated Nov. 10, 2015, 7 Pages.
(Continued)

*Primary Examiner* — Hai Tran
(74) *Attorney, Agent, or Firm* — Holzer Patel Drennan

(57) ABSTRACT

There is disclosed a multiband antenna device comprising a conductive elongate antenna element configured for electrical connection to a groundplane at a grounding point, and a conductive elongate feeding element configured for electrical connection to a radio transmitter/receiver at a feeding point. At least a major portion of the antenna element is configured to extend in a first direction and to double back on itself in a second, substantially counter-parallel direction forming a slot. The feeding point is adjacent to the grounding point, and the feeding element is configured to extend substantially parallel to the first and second directions of the major portion of the antenna element. The antenna device can operate in multiple frequency bands, and can be configured on a dielectric insulating former that fits compactly in a corner of a mobile communications handset housing.

19 Claims, 29 Drawing Sheets

(51) Int. Cl.
*H01Q 5/335* (2015.01)
*H01Q 1/24* (2006.01)
*H01Q 11/12* (2006.01)

(58) Field of Classification Search
USPC ..... 343/700 MS, 745, 850, 741
See application file for complete search history.

(56) References Cited

U.S. PATENT DOCUMENTS

| | | | | |
|---|---|---|---|---|
| 2003/0189525 | A1 | 10/2003 | Tan et al. | |
| 2004/0108957 | A1 | 6/2004 | Naoko et al. | |
| 2008/0180333 | A1* | 7/2008 | Martiskainen | H01Q 1/243 343/722 |
| 2009/0273521 | A1 | 11/2009 | Wong et al. | |
| 2009/0273530 | A1 | 11/2009 | Chi et al. | |
| 2009/0284433 | A1* | 11/2009 | Tsutsumi | H01Q 1/243 343/825 |
| 2010/0245201 | A1* | 9/2010 | Hossain | H01Q 1/243 343/848 |
| 2010/0328182 | A1* | 12/2010 | Wong | H01Q 1/2266 343/848 |
| 2011/0095949 | A1 | 4/2011 | Wong et al. | |
| 2011/0122027 | A1* | 5/2011 | Wong | H01Q 1/243 343/700 MS |
| 2011/0128200 | A1* | 6/2011 | Hossain | H01Q 7/00 343/745 |
| 2011/0156958 | A1 | 6/2011 | Wong et al. | |
| 2011/0227806 | A1 | 9/2011 | Wong et al. | |
| 2012/0154222 | A1 | 6/2012 | Oh et al. | |

FOREIGN PATENT DOCUMENTS

| | | | |
|---|---|---|---|
| CN | 101944656 | A | 1/2011 |
| CN | 101953022 | A | 1/2011 |
| CN | 102315513 | A | 1/2012 |
| EP | 1345282 | A1 | 9/2003 |
| EP | 2117073 | A1 | 11/2009 |
| EP | 2348574 | A1 | 7/2011 |
| EP | 2328229 | A3 | 2/2012 |
| EP | 2405533 | A1 | 11/2012 |
| GB | 2509297 | A | 2/2014 |
| WO | 9102386 | A1 | 2/1991 |
| WO | 02078123 | A1 | 10/2002 |
| WO | 03047031 | A1 | 6/2003 |
| WO | 2014059382 | A1 | 4/2014 |

OTHER PUBLICATIONS

Rowell, et al, "A Compact PIFA Suitable for Dual-Frequency 900/1800-MHz Operation", IEEE Transactions on Antennas and Propagation, vol. 46, No. 4, Apr. 1998, 3 pages.

Search Report for UK Patent Application No. 1218286.1, search dated Feb. 5, 2013, Intellectual Property Office, 6 pages.

International Searching Authority, U.S. Patent and Trademark Office, International Search Report for PCT/US2013/064715, dated Jan. 31, 2014, 4 pages.

International Searching Authority, U.S. Patent and Trademark Office, Written Opinion for PCT/US2013/064715, dated Oct. 2, 2014, 7 pages.

"First Office Action and Search Report Issued in Chinese Patent Application No. 201380053247.3", dated May 30, 2016, 13 Pages.

"Second Office Action Issued in Chinese Patent Application No. 201380053247.3", dated Jan. 19, 2017, 10 Pages.

"Third Office Action Issued in Chinese Patent Application No. 201380053247.3", dated Jul. 18, 2017, 9 Pages.

"Office Action Issued in Chinese Patent Application No. 201380053247.3", dated Jan. 10, 2018, 5 Pages.

* cited by examiner

MULTIBAND ANTENNA

The present application is a U.S. 371 National Phase Patent Application and claims benefit of Patent Cooperation Treaty Application PCT/US2013/064715, entitled "Multiband Antenna" and filed 11 Oct. 2013, which takes priority from U.K. Patent Application 1218286.1 entitled "Multiband Antenna" and filed 11 Oct. 2012, both of which are incorporated herein by reference in their entirety.

Embodiments of the present invention relate to a multiband antenna capable of operating in multiple frequency ranges. In particular, but not exclusively, embodiments of the present invention provide a substantially more compact multiband antenna solution suitable for use in personal communication devices such as smartphones and tablets.

BACKGROUND

Antennas are normally connected to a radio by a direct galvanic connection. However, it has been shown that feeding an antenna through a capacitive gap (e.g. between a conductive strip and a feeding structure) can provide several advantages for certain types of antenna. The advantages are particularly useful for larger impedance matching bandwidth. See, for example, U.S. 2003/0189625 or Rowell & Murch, "Compact PIFA Suitable for Dual-Frequency 900/1800-MHz Operation", IEEE Transactions on Antennas and Propagation, Vol. 46, No. 4, April 1998, pp. 596-598.

The single band antenna shown in FIG. 1 of Rowell & Murch has a wide feeding plate that extends across a slot formed in the main antenna element. The dual band antenna shown in FIG. 2 has a separate antenna element and a separate capacitive feed for the upper frequency band of the antenna. It is clear that the authors of this paper have not considered the possibility of creating multiple resonance behaviour with a single antenna element and a single capacitive feed.

EP1345282 discloses a multiband radio antenna device (1) for a radio communication terminal, comprising a flat ground substrate (20), a flat main radiating element (2,9) having a radio signal feeding point (3), and a flat parasitic element (5,6). The main radiating element is located adjacent to and in the same plane as the ground substrate, and preferably dielectrically separated therefrom. The antenna device is suitable for being used as a built-in antenna in portable radio terminals, such as a mobile phone (30). However, it is to be noted that this antenna is not a capacitively fed antenna. In EP1345282, the feeding element is also the longest element and the one that gives the lowest resonant frequency as well as the multiband behaviour; the antenna would still work at the same lowest resonance if the capacitively coupled element were removed.

EP2405533 discloses a capacitively fed antenna including an inductive element (181) that is required to create the multiband resonance behaviour of the antenna. Moreover, the feeding element shown in EP2405533 is configured so as to start at a point remote from the grounding point of the antenna and to run towards the grounding point in the opposite direction to that of the radiating arms of the antenna.

US2012/0154222 shows an antenna structure comprising a long, U-shaped element and a shorter, inverted L-shaped element. Here, the U-shaped element is driven and the L-shaped element is shorted to ground.

FIG. 1 of the present application illustrates a known capacitively fed antenna. The antenna 102 is connected to the ground plane 106 and folded at point A so that at least part of the antenna is in a plane substantially parallel to the ground plane 106. Folding the antenna in this manner reduces the overall height of the antenna device. The antenna 102 is connected to the ground plane 106 at the grounding point 108. The radio transmitter/receiver 110 is connected to the feeding structure 104, and a small capacitive gap 112 is formed between the feeding structure 104 and the antenna 102. The capacitance of the capacitive gap 112 is a design parameter and depends on the frequency of operation. For example, the capacitance of the gap 112 could be approximately 2 pF for a frequency of operation of around 1 GHz.

Typically the capacitive gap 112 is positioned close to the grounding point 106 of the antenna 102. In this configuration, the impedance of the antenna at the capacitive gap 112 is close to the characteristic impedance of the radio system, for example, 50.

The antenna illustrated in FIG. 1 is typical of capacitively fed antenna devices, however there are various ways in which the overall size of the antenna may be reduced by folding the antenna. Furthermore, it is possible to create multiple resonances by the addition of branches on the antenna 102. It should be noted that the antenna device illustrated in FIG. 1 is an unbalanced structure and the ground plane 106 of the antenna device is an integral part of the radiating structure and plays a major role in the overall performance of the antenna device.

The type of structure illustrated in FIG. 1 is widely used in many devices (e.g. cellular antenna for mobile phones, laptops, etc.) and many variations are disclosed in the prior art.

SUMMARY

Viewed from a first aspect, there is provided a multiband antenna device comprising a conductive elongate antenna element configured for electrical connection to a groundplane at a grounding point, and a conductive elongate feeding element configured for electrical connection to a radio transmitter/receiver at a feeding point, wherein at least a major portion of the antenna element is configured to extend in a first direction and to double back on itself in a second, substantially counter-parallel direction, the antenna element thereby forming a slot, wherein the feeding point is adjacent to the grounding point, and wherein the feeding element is configured to extend substantially parallel to the first and second directions of the major portion of the antenna element and to couple capacitively with the antenna element during operation of the antenna device.

The antenna element may comprise an elongated conductive strip and may have at least three portions. The first portion may be electrically connected to the groundplane at the grounding point in a substantially perpendicular arrangement; the second portion may be substantially parallel to an edge of the ground plane; and the third portion may be folded back on itself such that it is parallel to the second portion, forming a slot between the second and third portions of the antenna element. The feeding element may include an elongate conductive strip having a width to length ratio of less than 1:5. The total length of the feeding element must be significantly shorter than the shortest resonant length at the lowest frequency of operation (in some embodiments typically around $\lambda/4$, where $\lambda$ is the wavelength at the lowest frequency of operation), but must not be so short that it does not have a usable coupling capacitance with the antenna element. In some embodiments, the feeding element has a length between $\lambda/25$ and $\lambda/8$ at the lowest frequency of operation. One end of the feeding element is connected to the radio transmitter/receiver in close proximity to the grounding point at which the antenna element is connected to the groundplane. The feeding element has two portions: the first portion being substantially parallel to the first portion of the antenna element, and the second portion being substantially parallel to the second portion of the antenna element. The second portion of the feeding element is arranged to form a capacitive gap providing capacitive coupling between the feeding element and the second portion of the antenna element.

The advantage of this arrangement is improved useable frequency bandwidth, multiband behaviour, and compactness of the antenna device.

The antenna device may be formed on a dielectric substrate such as a PCB made of FR4 or Duroid® or the like, with the groundplane formed as a conductive layer on the substrate, and the antenna and feed elements formed as conductive tracks on the dielectric substrate in an area where no groundplane is present. The groundplane may define an edge, and the respective portions of the antenna and feed elements are preferably configured to be substantially parallel to the edge of the groundplane The antenna element and feeding may be in substantially the same plane. Alternatively, they may be in substantially parallel planes, for example formed on opposed surfaces of the dielectric substrate.

The feeding element may extend between the second portion of the antenna element and the edge of the groundplane, or may extend between the second and third portions of the antenna element.

The second portion of the antenna element may additionally be provided with a coupling branch in the form of an additional conductive element that extends from the second portion and runs back towards the grounding point in a direction substantially parallel to the second portion. This can be desirable, especially at low frequencies, since it can increase the coupling between the feeding element and the second portion of the antenna element without reducing the spacing there between to a level where manufacturing tolerances become a problem. The coupling branch and the second portion of the antenna element may be considered as partially surrounding the feeding element.

In some embodiments, the antenna element may be provided with at least one additional portion in the form of a branch extending from the second portion that introduces an additional resonance. The branch may extend in substantially the same direction as the third portion of the antenna element, or in substantially the opposite direction. In some embodiments, the branch may be configured to couple capacitively with at least part of the third portion of the antenna element. In addition to increasing bandwidth, the branch may also be configured to create an additional resonance. Advantageously, the branch is stemmed from the second portion near the grounding point, since this helps to enhance the bandwidth of higher resonances or the creation of additional resonances without overly degrading the behaviour at the lower or lowest resonance.

One advantage of present embodiments is that the antenna device generally works well even when the groundplane is extended on one side of the antenna device. This is attractive in applications where the antenna device cannot protrude completely from the groundplane profile due to space considerations.

The antenna device may also be bent around a corner of the groundplane, for example around a corner of a PCB. This allows for additional saving of space on small PCBs.

The frequency of the lowest resonance may easily be adjusted by connecting the antenna element to the groundplane at the grounding point by way of an impedance element, such as an inductor and/or a capacitor. If the impedance element is an inductor, then the frequency of the lowest resonance is lowered; if it is a capacitor, then the frequency is raised.

The antenna device may be made electronically tuneable by connecting the antenna element to the groundplane at the grounding point by way of an electronically controlled variable impedance, for example a varicap diode. Alternatively, the antenna element may be connected to the groundplane through an electronically controlled RF switch that commutes between two or more impedance elements of different types or values (inductors and/or capacitors), thereby enabling the antenna device to operate in a corresponding number of different states.

In some embodiments, the end of the feeding element remote from the feeding point may be connected to the groundplane. This arrangement normally improves the bandwidth in the upper resonance at the expense of a small reduction in bandwidth at the lower resonance. The connection may be a simple galvanic connection, or may be through an impedance element such as a capacitor or inductor, thereby allowing the feeding point impedance to be optimized by simply adjusting the value of the impedance element.

In another embodiment, the antenna element and the feeding element may be formed or disposed on a dielectric support which is then mounted in a generally perpendicular manner on a substrate bearing the groundplane, thereby forming a three dimensional structure.

BRIEF DESCRIPTION OF THE DRAWINGS

Embodiments of the invention are further described hereinafter with reference to the accompanying drawings, in which.

DETAILED DESCRIPTION

Figure 1:
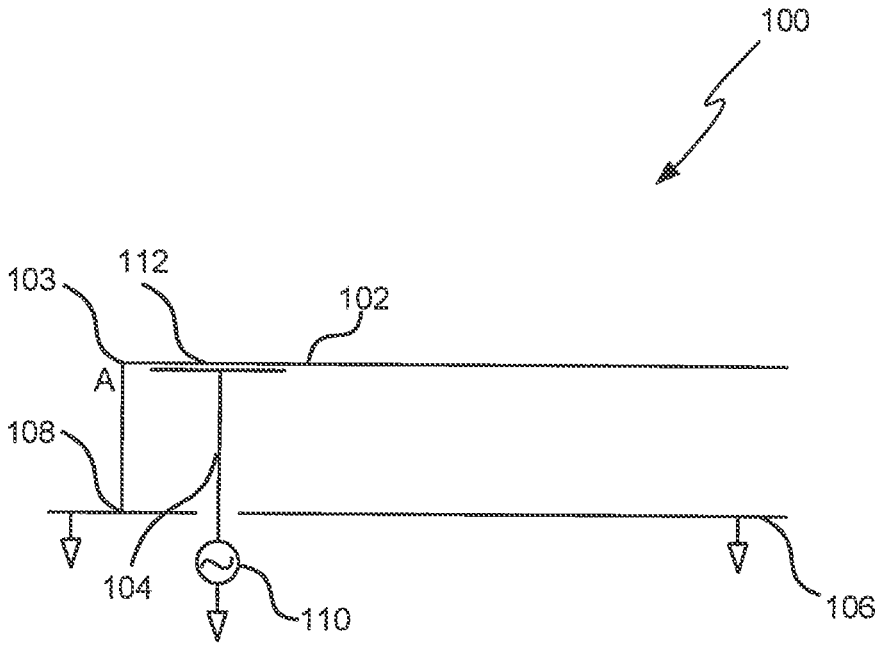
FIG. 1 shows a known capacitively fed antenna.
Figure 2:
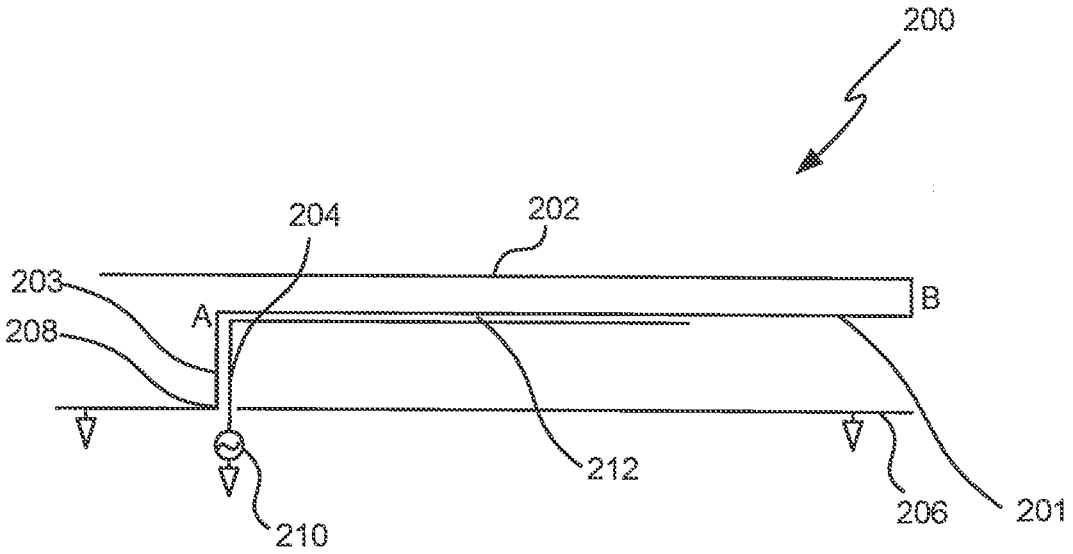
FIG. 2 shows an antenna device with an elongated antenna element and an elongated capacitive feeding element.

FIG. 2 illustrates a preferred embodiment of the present invention. It has been found that a particular arrangement of the more general capacitively fed antenna of FIG. 1 has several significant advantages in terms of the useable frequency bandwidth, the multiband behaviour and compactness of capacitively fed antennas.

To realise the advantages noted above, the antenna element 202 is of the form of a conductive elongated strip connected to the groundplane 206, and is configured to lie in a plane parallel to the groundplane. Furthermore, the antenna element is folded on itself, approximately half way along its length at point B 201. The resultant U-shape maintains a long antenna and therefore the lowest resonance frequency available to the antenna. The U-shape may also be thought of as a slot 213 (shown in FIG. 3) within the antenna element formed by the two major portions of the antenna element. Folding the antenna element 202 also minimises the space required to accommodate the antenna device.

The feeding element 204 is also an conductive elongated strip. A conductive elongated strip can be considered to be one in which the ratio of width to length is ⅕ or smaller. The feeding element 204 is electrically connected to the groundplane 206 at a feeding point along the groundplane, in close proximity to the grounding point 208 of the antenna element 202 and is configured to run substantially parallel to a portion of the antenna in the same direction. The feeding element 204 must have sufficient length so as to provide a useable coupling capacitance. It should be noted that the total length of the feeding element must be shorter than the shortest resonant length at the lowest operation frequency, yet still be long enough to ensure that the coupling capacitance is effective.

In FIG. 2, the antenna element 202 is shown having three portions. The first portion is connected to the groundplane at the grounding point 208 and runs to the first folding point, point A. The first portion 203 is positioned substantially perpendicular to the edge of the groundplane. The second portion 201 runs from point A, in a direction substantially parallel to the edge of the groundplane to folding point B. The antenna is then folded back on itself to form a U shape or slot, such that the free end portion (i.e. third portion) runs counter-parallel to the direction of the second portion.

Figure 3:
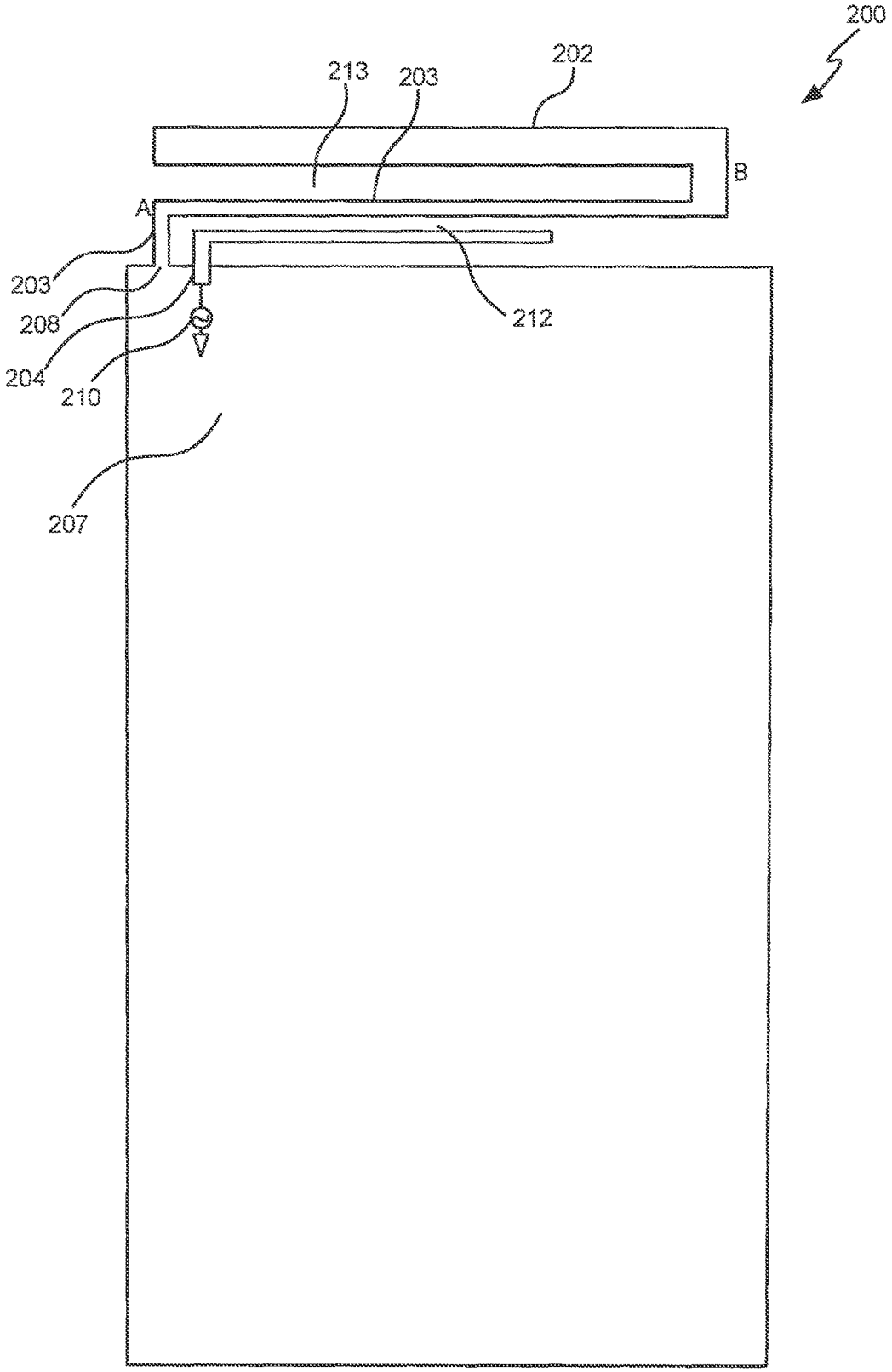
FIG. 3 shows a planar structure of the antenna device.

FIG. 3 illustrates a planar structure of the preferred embodiment of FIG. 2. The planar structure is formed by etching a printed circuit board (PCB), or by stamping metal or other method. The planar structure has several design parameters. For instance, the lowest resonant frequency of the antenna device 200 is determined by the overall length of the antenna element 202, the width of the first 203 and second 201 portions of the antenna element, especially in the region in close proximity to the grounding point 208, and the distance from the groundplane 206. The antenna device depicted in FIG. 3 provides a first and second resonance, and the second resonance is at a higher frequency than the first resonance frequency due to the fold in the antenna element 202 at point B. The frequency of the second resonance depends on the depth of the slot 213, the ratio of the length of the free end portion 202 to the length of the second portion 201, as well as other parameters. The same antenna element in an unfolded or 'straightened out' arrangement exhibits just a single low band resonance. The value of the impedance of the antenna element at the resonance frequencies and the relative bandwidth of the antenna device may be optimized by adjusting the length of the elongated conductive feeding element 204 and the width of the capacitive gap 212 between the feeding element 204 and the antenna element 202.

Figure 4:
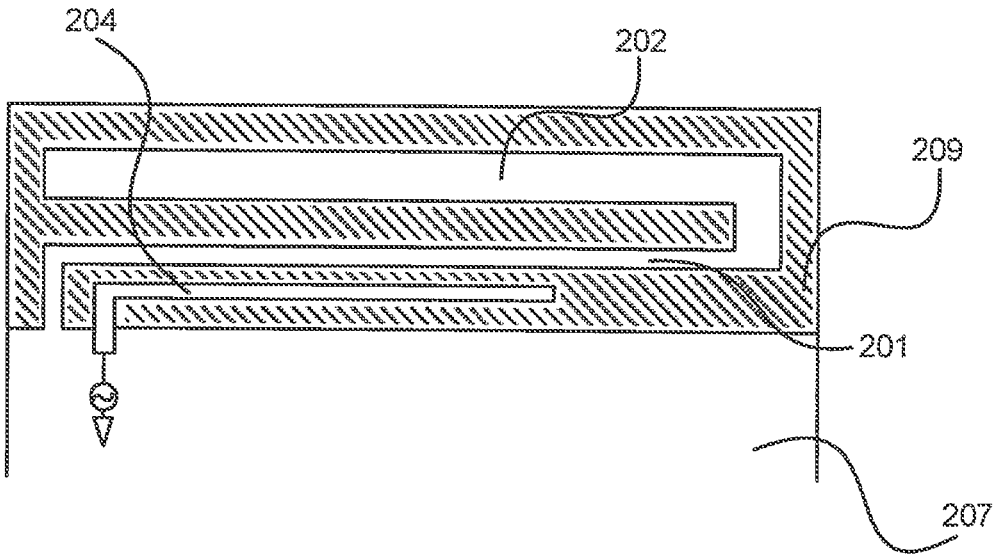
FIG. 4 shows the antenna device on a printed circuit board (PCB)
Figure 5:
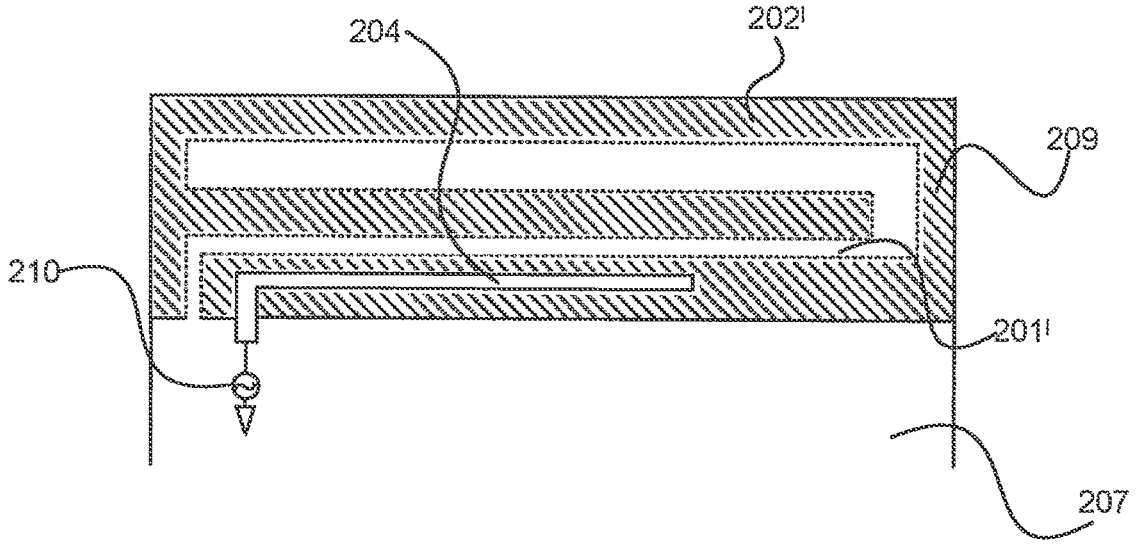
FIG. 5 shows an antenna device with the antenna element and feeding element formed on opposite sides of a PCB.

In a typical planar implementation the antenna element 202 and the feeding element 204 are created by etching the PCB which also includes the ground structure 207 (the ground plane in a planar arrangement is described as a ground structure), and therefore the antenna element 202 and the feeding element 204 are supported by the dielectric material 209 as shown in FIG. 4. It is also possible to etch the antenna element 202' on one side of the PCB, and etch the feeding element 204 on the other side of the PCB, as shown in FIG. 5. In general, the electronic circuitry constituting the radio transmitter/receiver 210, and other components (battery, LCD, speakers, etc.) are soldered or connected to the ground structure 207.

The arrangement shown in FIG. 5 may be implemented as a stand-alone surface-mount antenna device in which the antenna element 202' and feeding element 204 are etched on separate PCBs and then soldered to the main PCB having the ground structure 207 and electronic components. In a typical embodiment the feeding element 204 is etched onto the lower surface of the PCB and the antenna element 202 is etched onto the upper surface of the PCB and connected to ground by means of a conductive strip. It should be noted that other configurations are possible.

Figure 6:
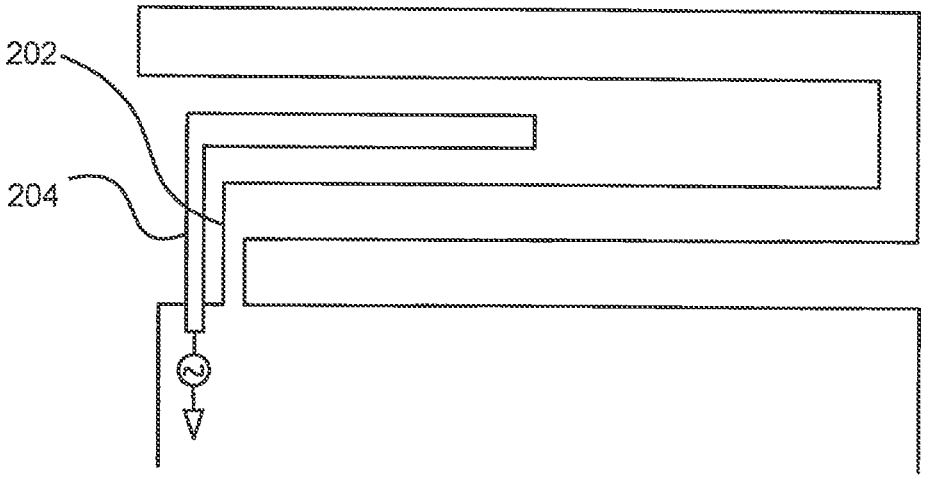
FIG. 6 shows an alternative embodiment of the antenna device.

In the embodiments shown in FIGS. 3, 4 and 5, the feeding structure 208 is positioned between the antenna element 202 and the groundplane 206. In an alternative embodiment shown in FIG. 6, the feeding element 204 extends inside the slot 213 created by the fold in the antenna element 202.

Figure 7:
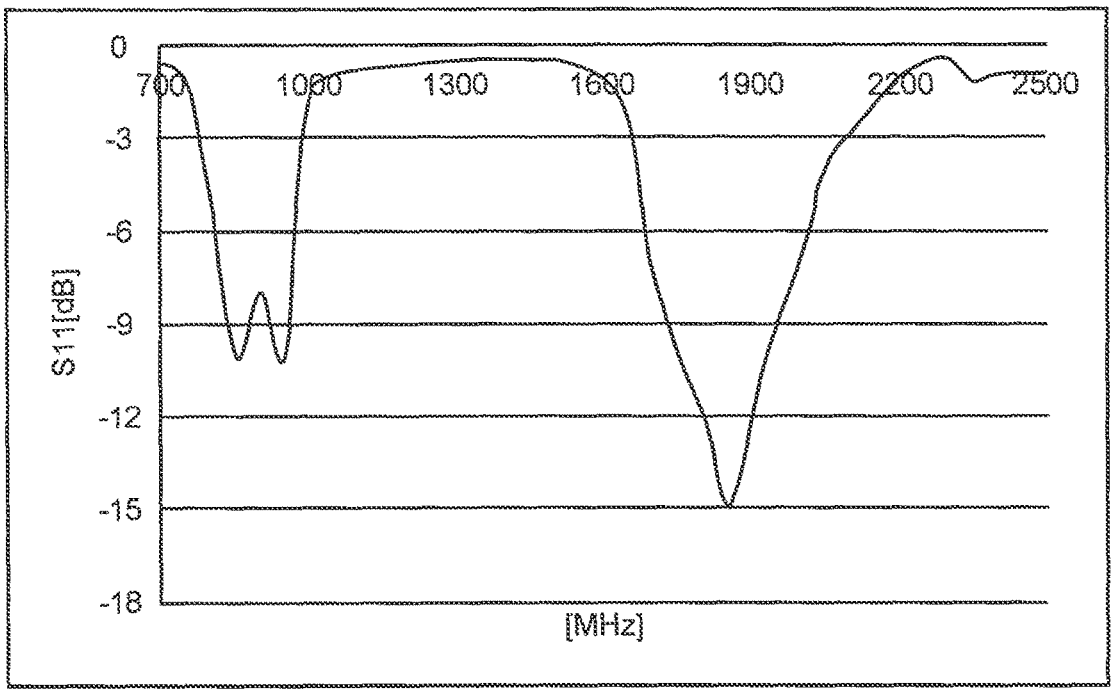
FIG. 7 is an impedance matching plot for the antenna device of FIG. 4.

FIG. 7 shows a plot of the impedance matching of the antenna device shown in FIG. 4. FIG. 7 shows three characteristic troughs, each representing a corresponding frequency range.

Figure 8:
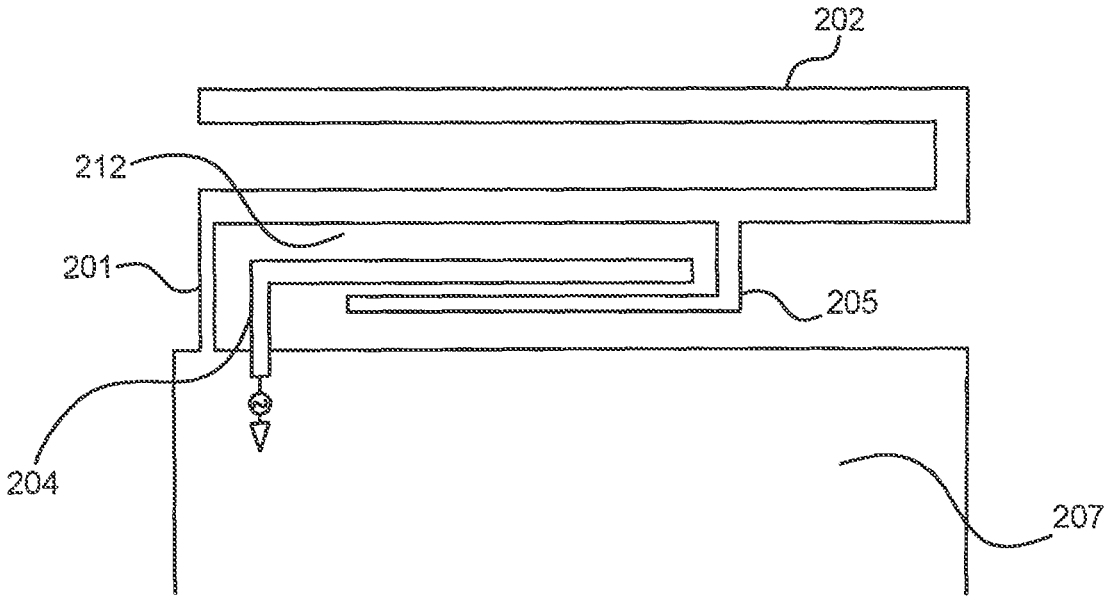
FIG. 8 shows an embodiment with an auxiliary coupling branch.

FIG. 8 illustrates a further preferred embodiment for an antenna able to operate at lower frequencies. An auxiliary coupling branch 205, electrically connected to the antenna 202, is positioned between the feeding element 204 and the ground structure 207, and increases the coupling between the antenna element 202 and the feeding element 204. Furthermore, by introducing an auxiliary coupling branch 205, the reduction in the width of the capacitive gap 212 between the antenna element 202 and the feeding element 204 does not change. If the capacitive gap 212 is too small, problems arise with manufacturing the antenna devices and with antenna tolerance.

Figure 9:
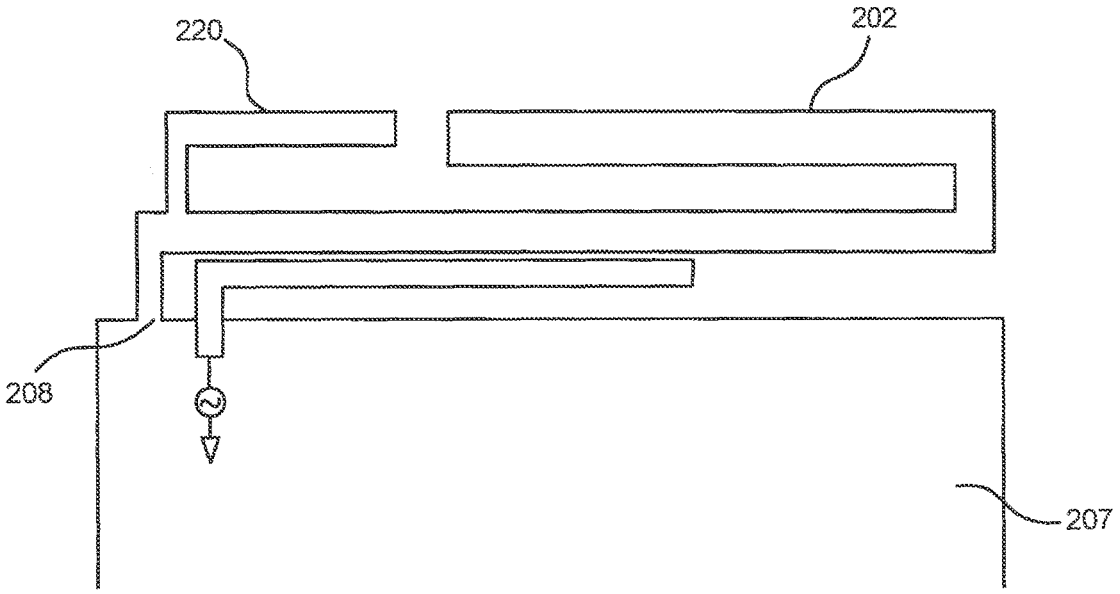
FIGS. 9 to 11 show alternative embodiments with an additional branch for improving bandwidth or introducing an additional resonance.
Figure 10:
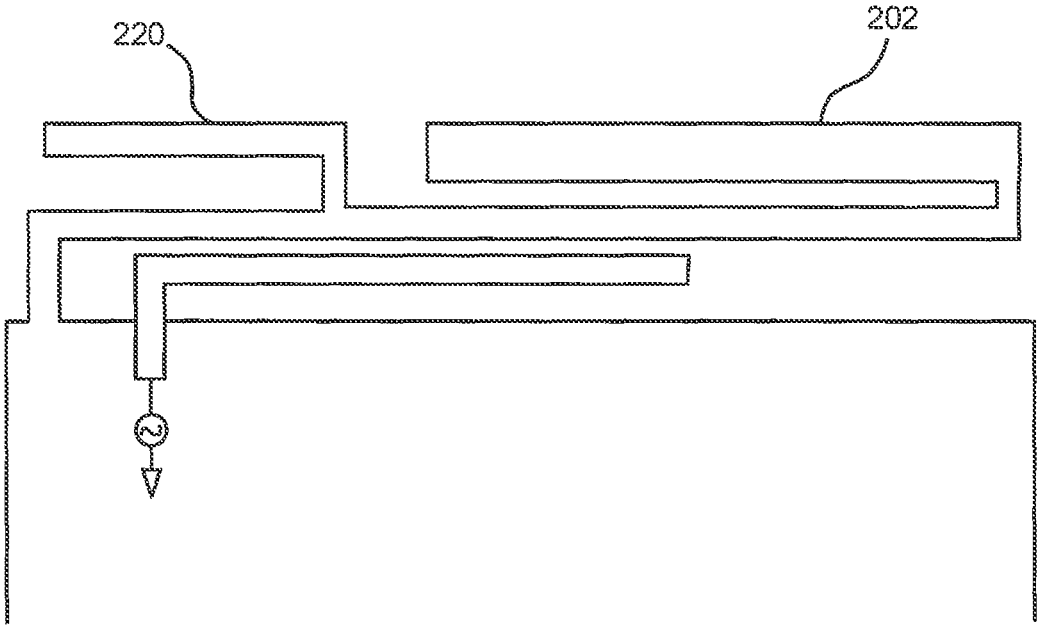
Figure 11:
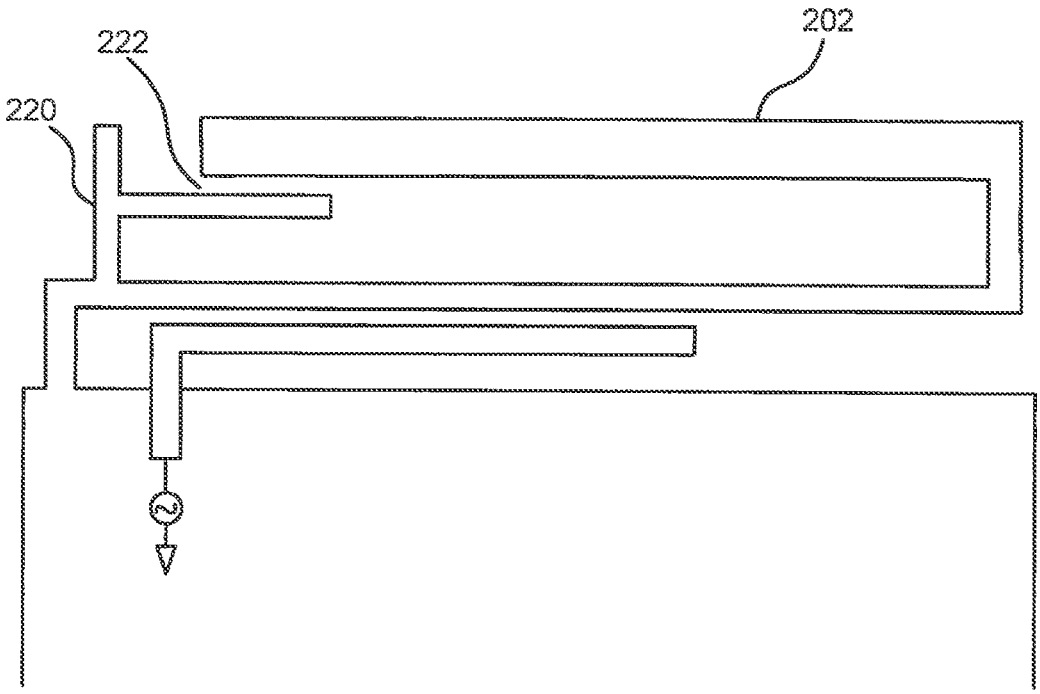

FIGS. 9, 10 and 11 illustrate preferred embodiments of the antenna device providing enhanced frequency bandwidth in the second resonant frequency band. This is achieved by adding a second branch 220 that stems from the second portion 201 of the antenna element 202 in close proximity to the grounding point 208. The second branch 220 may substantially follow the same direction as the antenna element 202 (see for example in FIG. 9) or alternatively may follow the opposite direction (see for example FIG. 10) of the antenna element 202. Furthermore, it is also possible to create a capacitive coupling between the second branch 220 and the end section of the antenna 202 by bringing them in close proximity to one another and thereby creating a small capacitive gap 222 (see for example FIG. 11).

Figure 12:
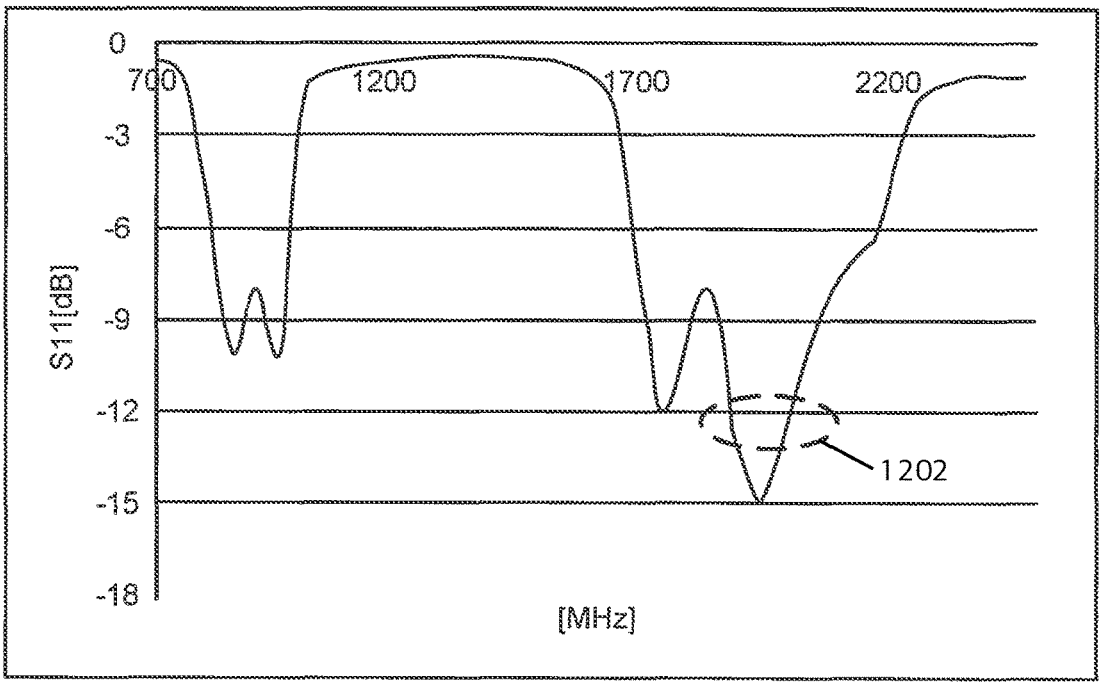
FIG. 12 is an impedance matching plot for the antenna device of FIG. 9.

FIG. 12 shows the plot representing impedance matching for the antenna device shown in FIG. 9. The additional second branch 220 stemming from the second portion 201 of the antenna element 202 creates an additional resonance and widens the high band. The additional resonance is highlighted by a dashed circle 1202 on the plot.

Figure 13:
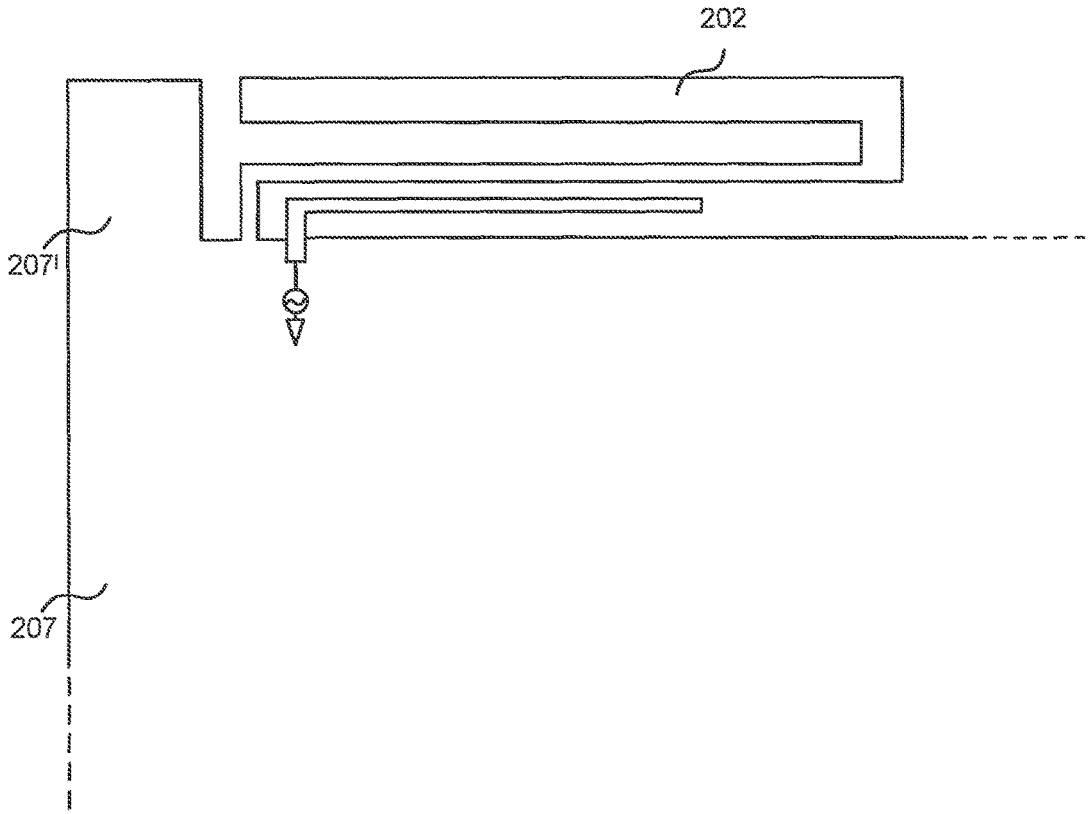
FIG. 13 shows an antenna device with the groundplane extended on one side of the antenna device.

FIG. 13 illustrates an antenna device with the ground structure extended 207' on one side of the antenna element 202. One advantage of the embodiments of the antennas disclosed here is that they generally work well even when the ground structure 207 is extended 207' on one side of the antenna 202, making it convenient for many applications where the antenna cannot protrude completely outside the extended ground structure profile 207'.

Figure 14:
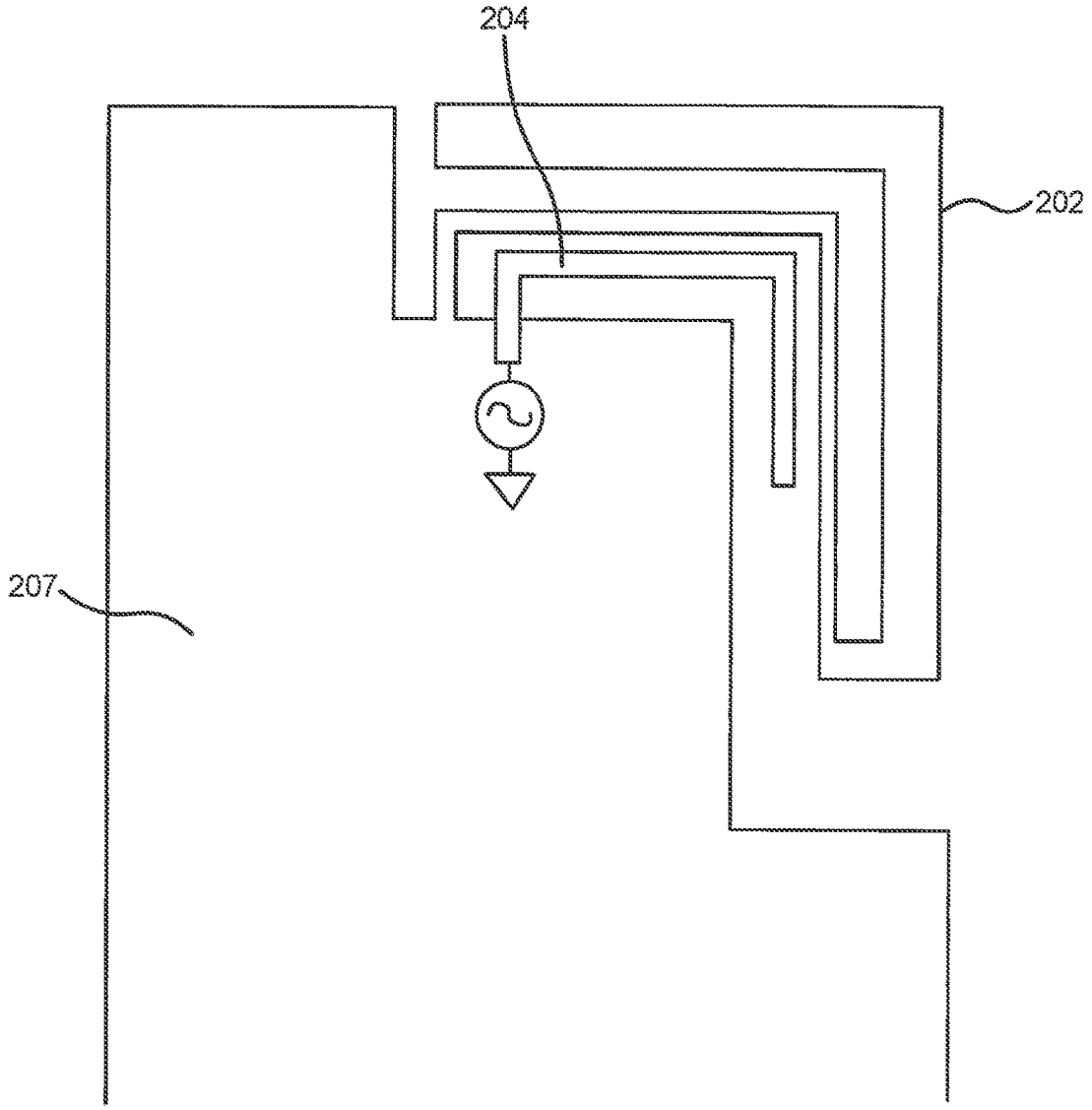
FIG. 14 shows an antenna device arranged to fit around a corner of the groundplane.

FIG. 14 illustrates the antenna device arranged to fit around the corner of the ground structure 207. In this embodiment, the antenna maintains its advantageous properties while also minimising the space it occupies.

Figure 15:
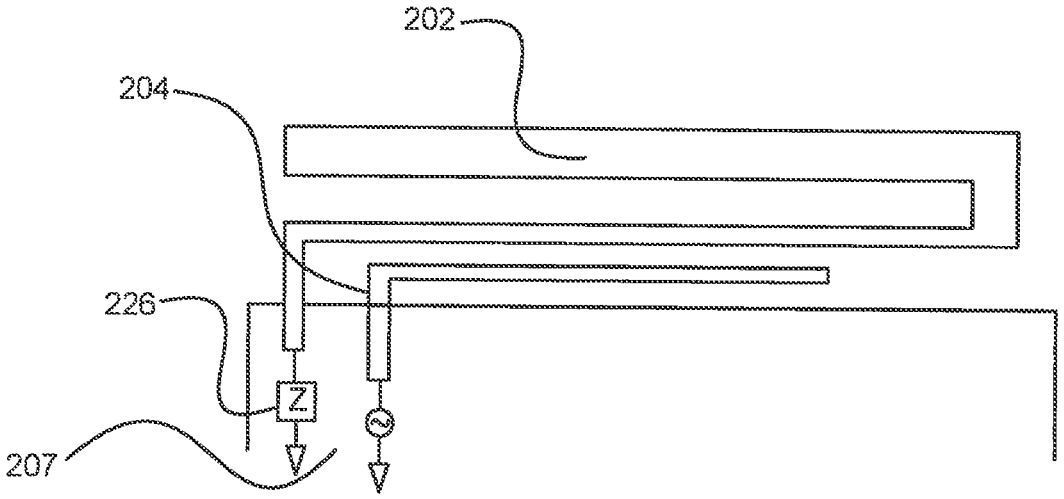
FIG. 15 shows an antenna device with an impedance element at the grounding point.

A further advantage of the class of antennas disclosed here is that the frequency of the lowest resonance can be easily adjusted by connecting the antenna element 202 to the ground structure 207 through an impedance element 226, e.g. an inductor or a capacitor. FIG. 15 shows the antenna element 202, the feeding element 204, the ground structure 207 and an impedance element 226. The frequency of the lowest resonance is varied by the varying the properties of the impedance element. If the impedance element 226 is an inductor, then the frequency of the lowest resonance is lowered. Alternatively, if the impedance element is a capacitor then the frequency of the lowest resonance is increased.

Figure 16:
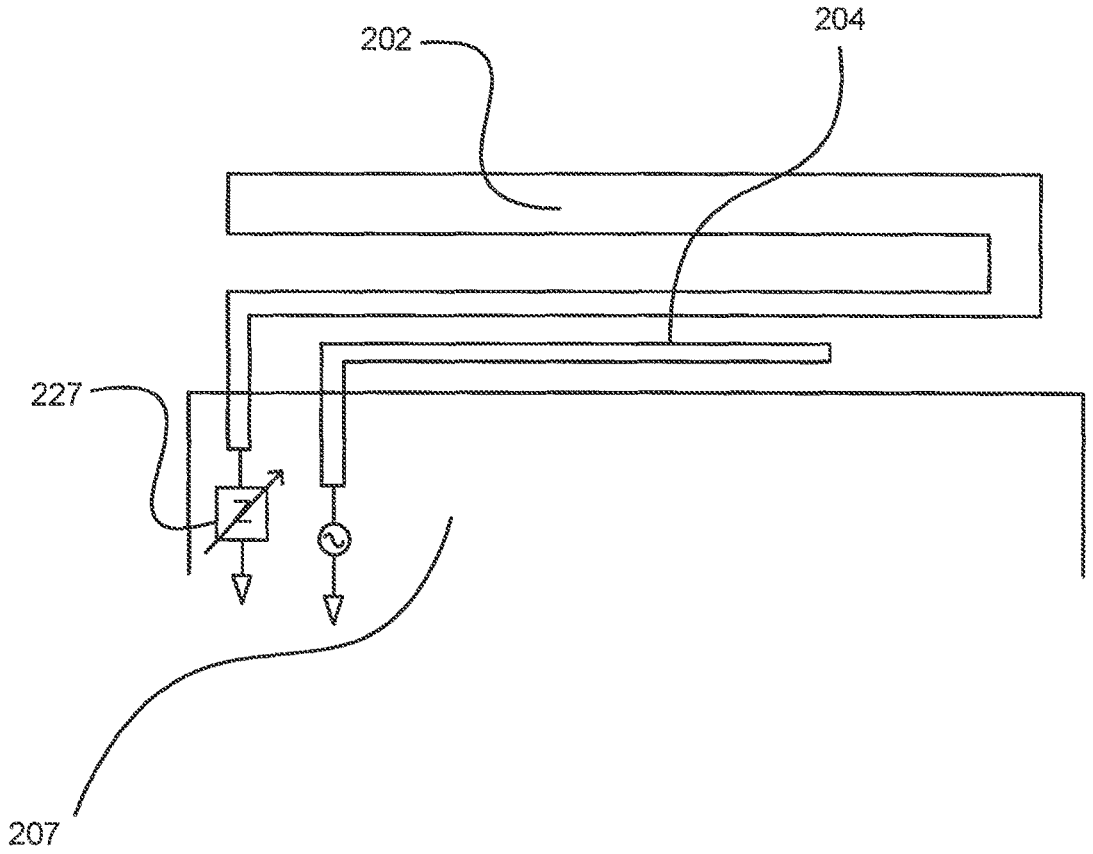
FIG. 16 shows an antenna device with an electronically variable impedance element at the grounding point.
Figure 17:
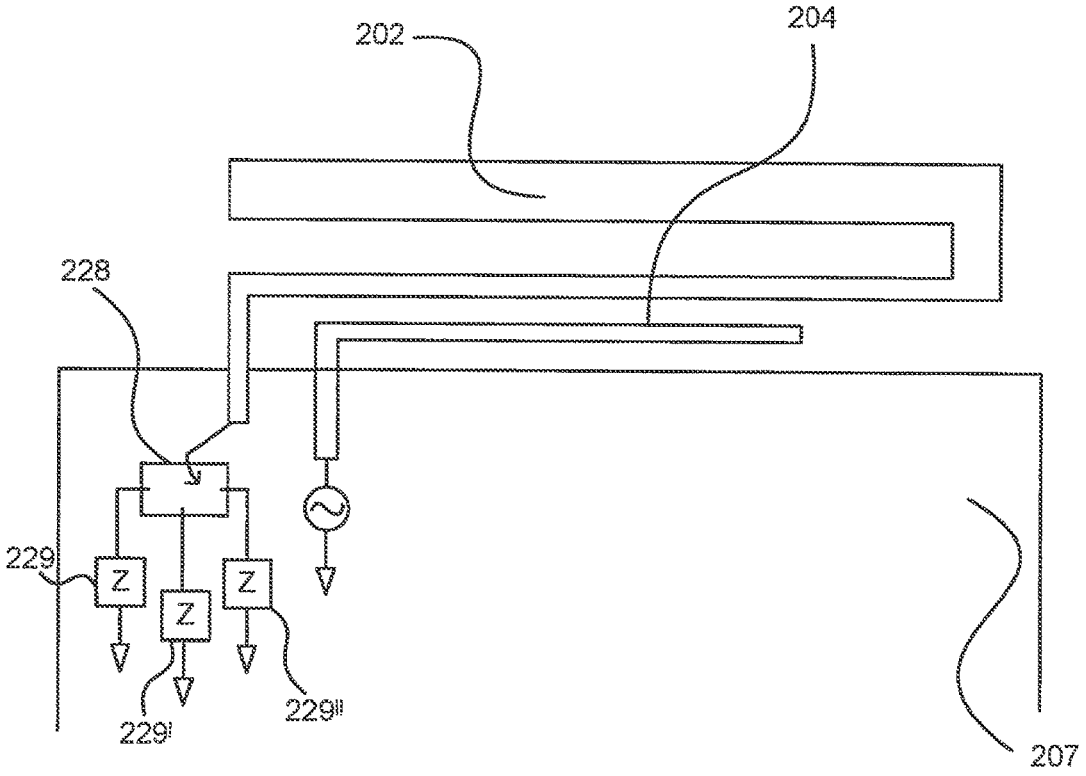
FIG. 17 shows an antenna device with an electronically controlled RF switch at the grounding point.

FIG. 16 illustrates a further advancement whereby the antenna device is electronically tuneable. Replacing the fixed impedance element 226 with an electronically controlled variable impedance element 227, such as a varicap diode, enables the variation of the frequency of the lowest resonance. Alternatively, as illustrated in FIG. 17, the antenna element 202 may be connected to an electronically controlled radio frequency (RF) switch 228 that commutes between two or more impedance elements 229, 229', 229" of different type or values (inductors and capacitors). Such an arrangement provides three different frequency states of the antenna device. For instance, in a first state the lowest resonance of the antenna device may cover the LTE700 frequency range (698-798 MHz) and in a second state the GSM850/900 range (824-960 MHz).

Figure 18:
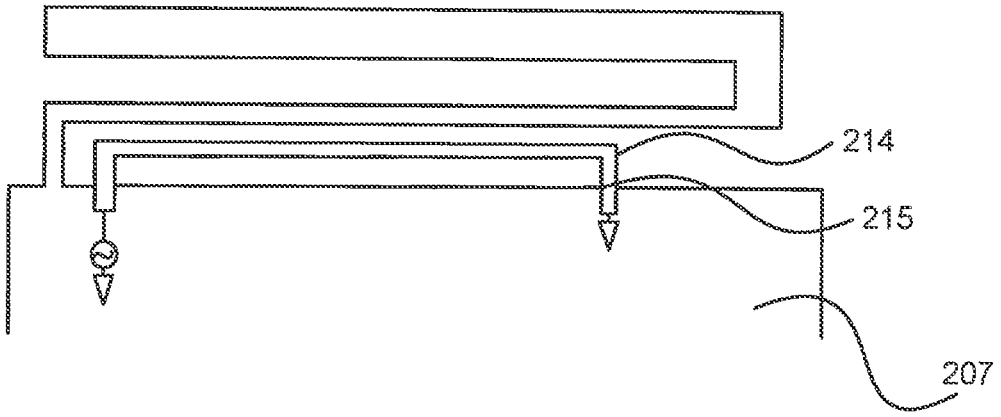
FIG. 18 shows an antenna device with the end of the feed element remote from the feeding point galvanically connected to the groundplane.
Figure 19:
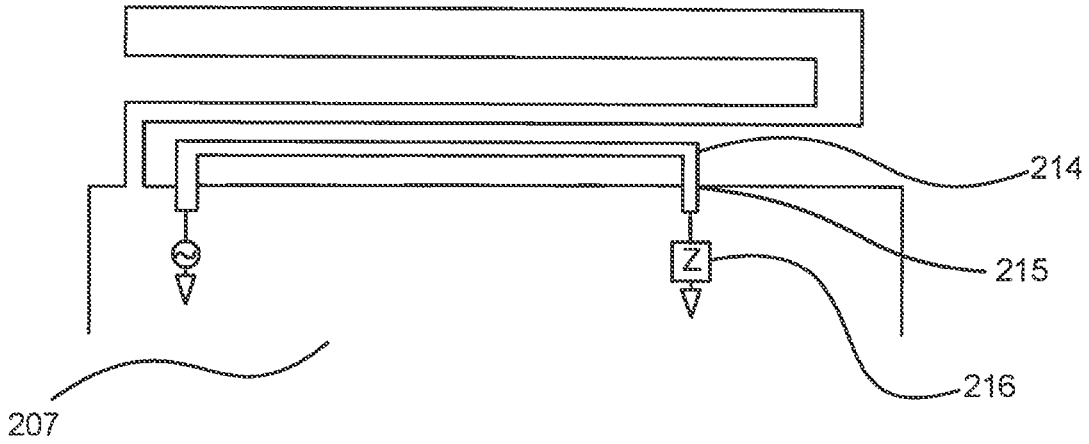
FIG. 19 shows an antenna device with the end of the feed element remote from the feeding point connected to the groundplane through an impedance element.

In another embodiment of the invention, illustrated in FIG. 18, the feeding element, which is normally open ended, is instead connected to the ground structure at the feeding element grounding point 215. The closed end feeding element 214 arrangement improves the bandwidth in the upper resonance, at the expense of a slight reduction of the bandwidth in the lower resonance. The feeding element grounding point 215 connection to the ground structure 207 may be replaced by a connection through an impedance element 216, e.g. an inductor or a capacitor. Such an arrangement allows optimization of the feed point impedance by simply adjusting the value of the lumped inductor or the capacitor 216. This arrangement is illustrated in FIG. 19.

Figure 20:
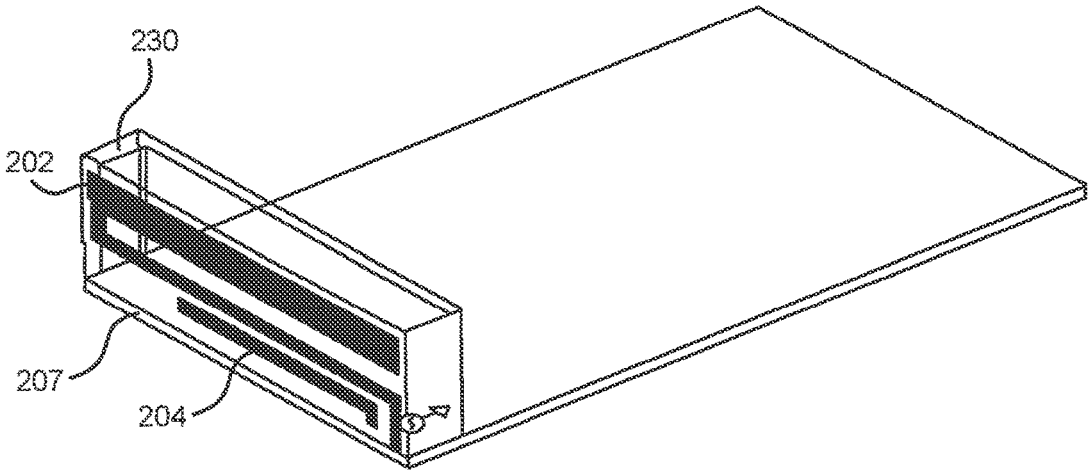
FIG. 20 shows an antenna device disposed perpendicularly to the groundplane.

FIG. 20 illustrates another embodiment of the invention, where the antenna element 202 is extended outside the plane containing the ground structure 207 to form a three dimensional structure. The antenna element 202 and the feeding element 204 are supported by a dielectric carrier 230. It should be understood that the dielectric carrier may be manufactured from plastic, resin, ceramic, or any other suitable material. The antenna element 202 and the feeding element 204 can be realized by many different manufacturing methods, for instance a conductor etched on a thin, flexible insulating layer (FPC) and attached to the dielectric carrier 230 using an adhesive layer; stamped metal parts or Laser Direct Structuring (LDS) techniques.

Figure 21:
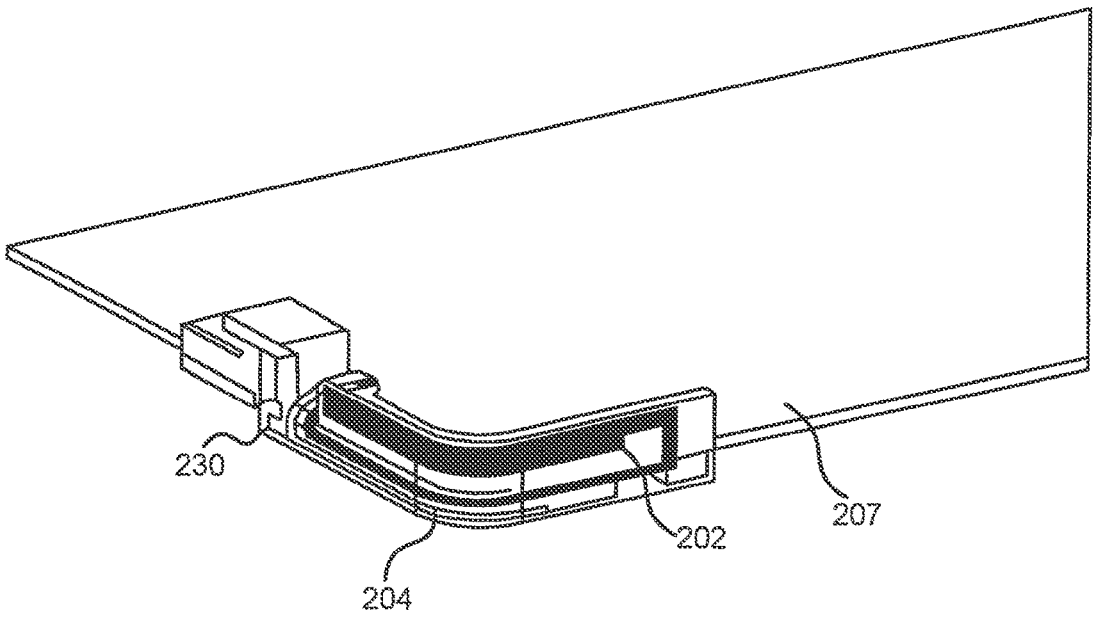
FIGS. 21 and 22 show an antenna device bent around the corner of the groundplane at one corner of a PCB.
Figure 22:
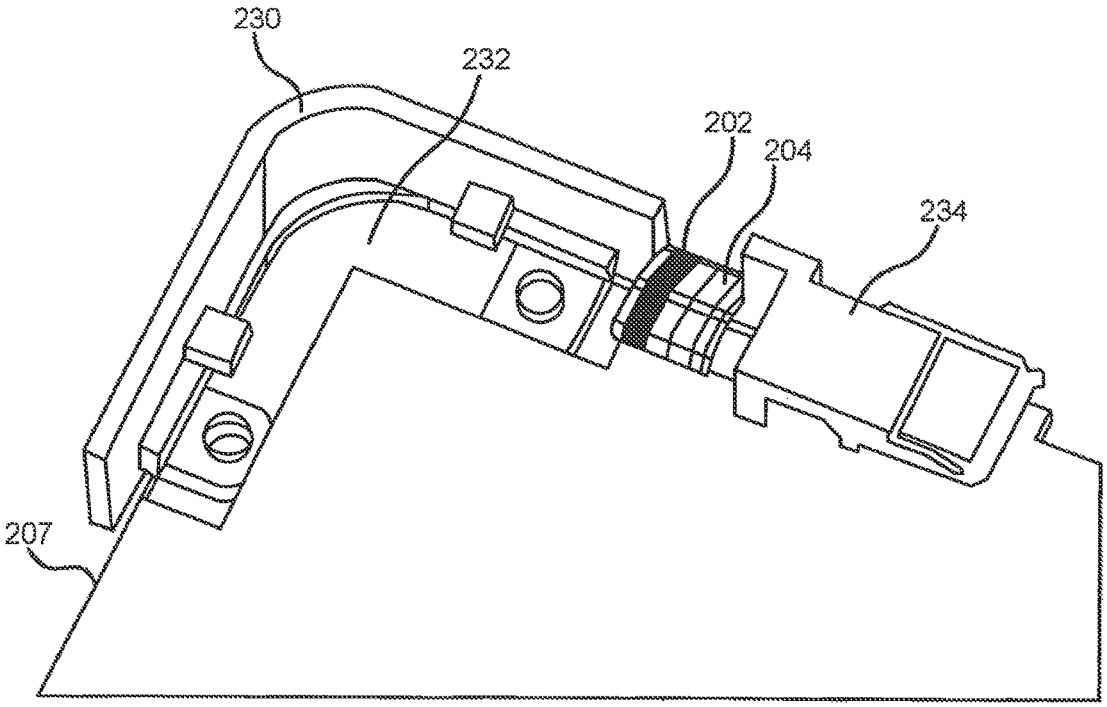
Figure 23:
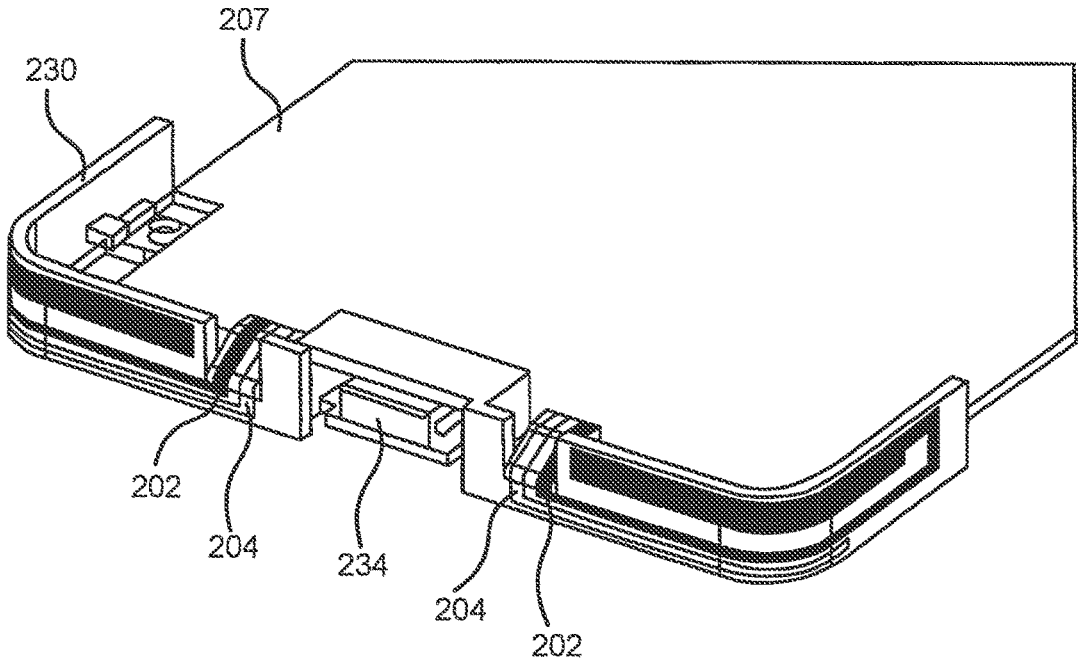
FIG. 23 shows a pair of antenna devices in a diversity arrangement bent around two corners of the groundplane at adjacent corners of a PCB.

In another embodiment the antenna device is bent around the corner of the ground structure 207 as illustrated in FIG. 21. As can be seen from the alternative view of FIG. 22, in such an embodiment it is generally necessary to add a clearance 232 between the ground structure 207 and the antenna element 202 and feeding element 204. This is in order to avoid the performance degradation that is common when an antenna element gets too close to the groundplane. This arrangement of the antenna device adapted to be arranged to fit around a corner is convenient in some devices where other components, such as a connector 234, occupy the straight edge of the ground structure. Moreover, the corner arrangement of FIGS. 21 and 22 enable the positioning of two antennas at opposite corners of the ground structure 207, thereby creating a symmetric diversity antenna pair or a symmetric multiple-input and multiple-output (MIMO) antenna pair, as shown in FIG. 23.

Figure 24:
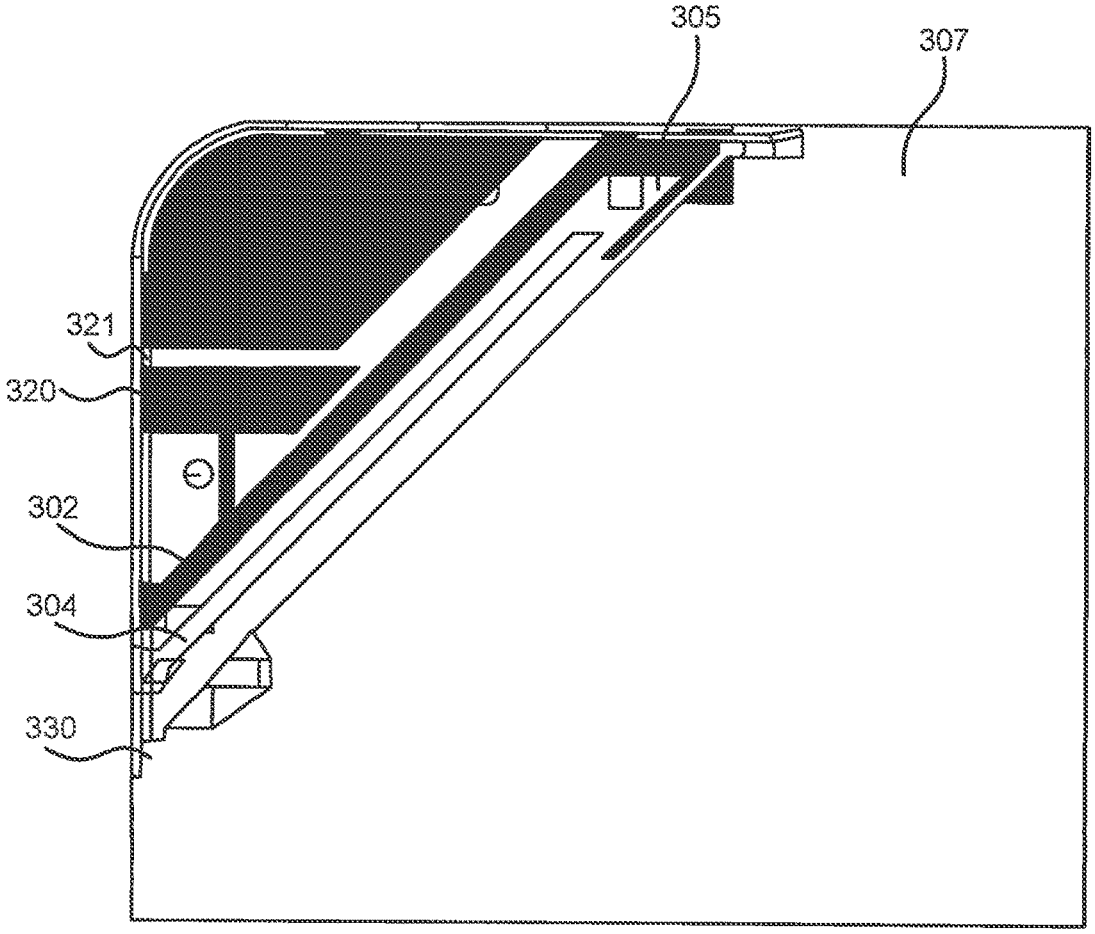
FIGS. 24 to 29 illustrate an antenna device where the antenna is formed on an insulating carrier for positioning on a corner of a PCB.
Figure 25:
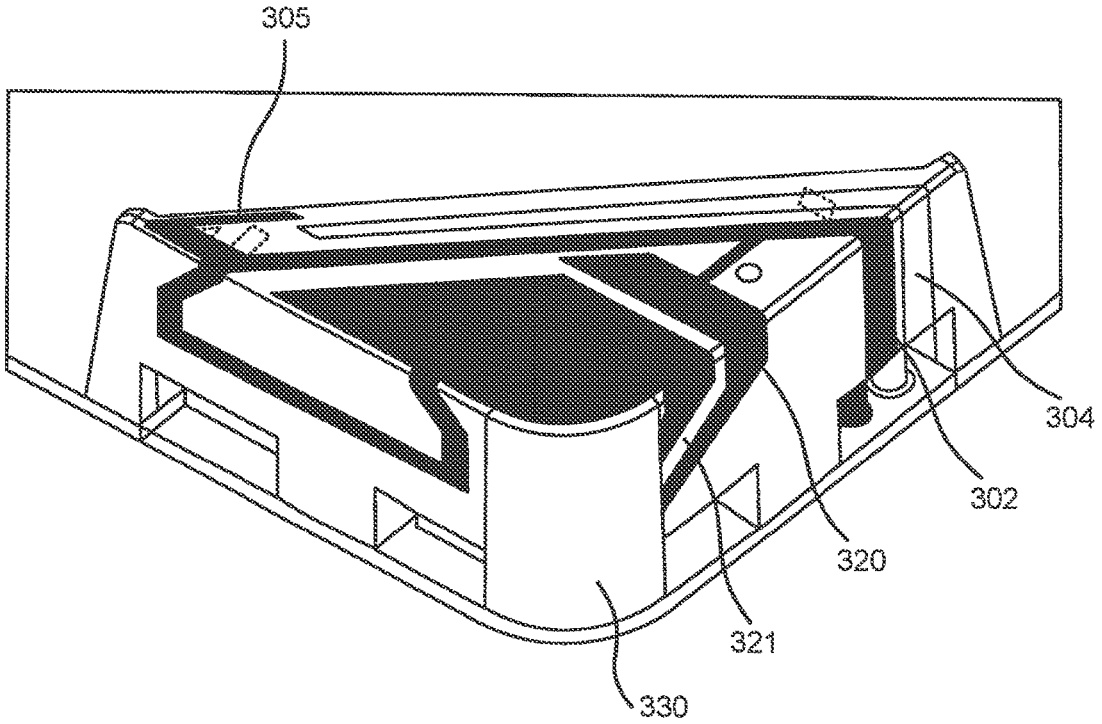

FIGS. 24 and 25 show an alternative embodiment of the present invention. In this embodiment the antenna 302 is formed on an insulating carrier 330 in the corner of the ground structure 307. The antenna 302 is connected to a grounding point 308. The antenna 302 is folded so that it extends in three orthogonal planes to maximize the space utilization and create a very compact structure. In this case the elongated feed structure 304 (connected to the feeding point 309) and the part of the antenna 302 portion parallel to it are oriented so that they form an angle of approximately 45° with the edge of the ground structure 307. In the complex embodiment of FIGS. 24 and 25, a second branch element 320 is formed on the carrier 330 and extends from the antenna 302 providing a second branch capacitive gap 321 between the antenna 302 and the second branch element 320. Furthermore, an auxiliary coupling branch 305 is formed on the carrier 330 and extending from the antenna 302.

Figure 26:
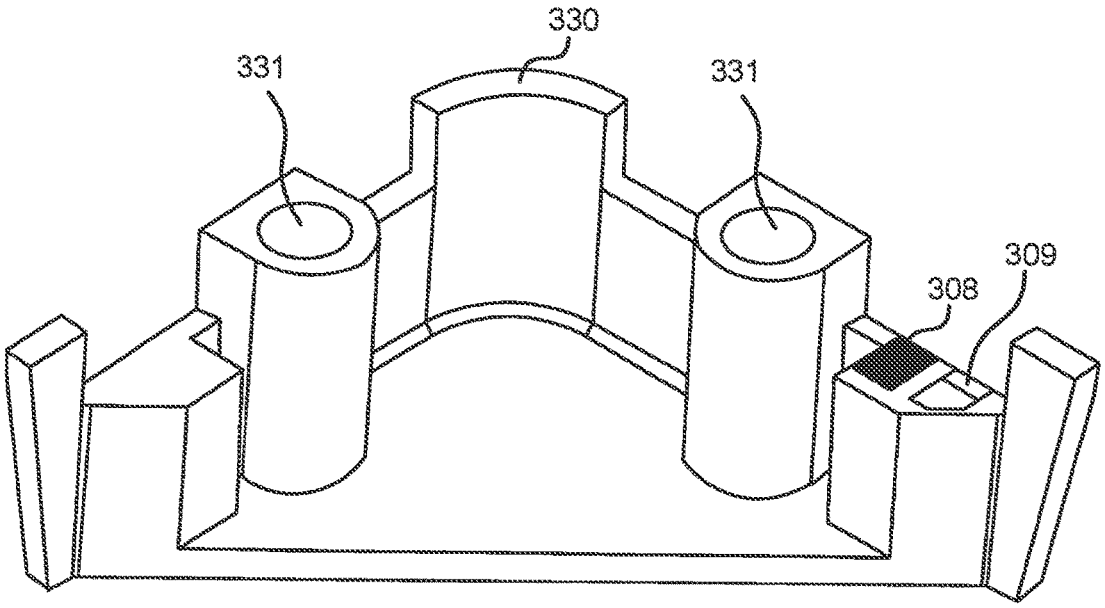
Figure 27:
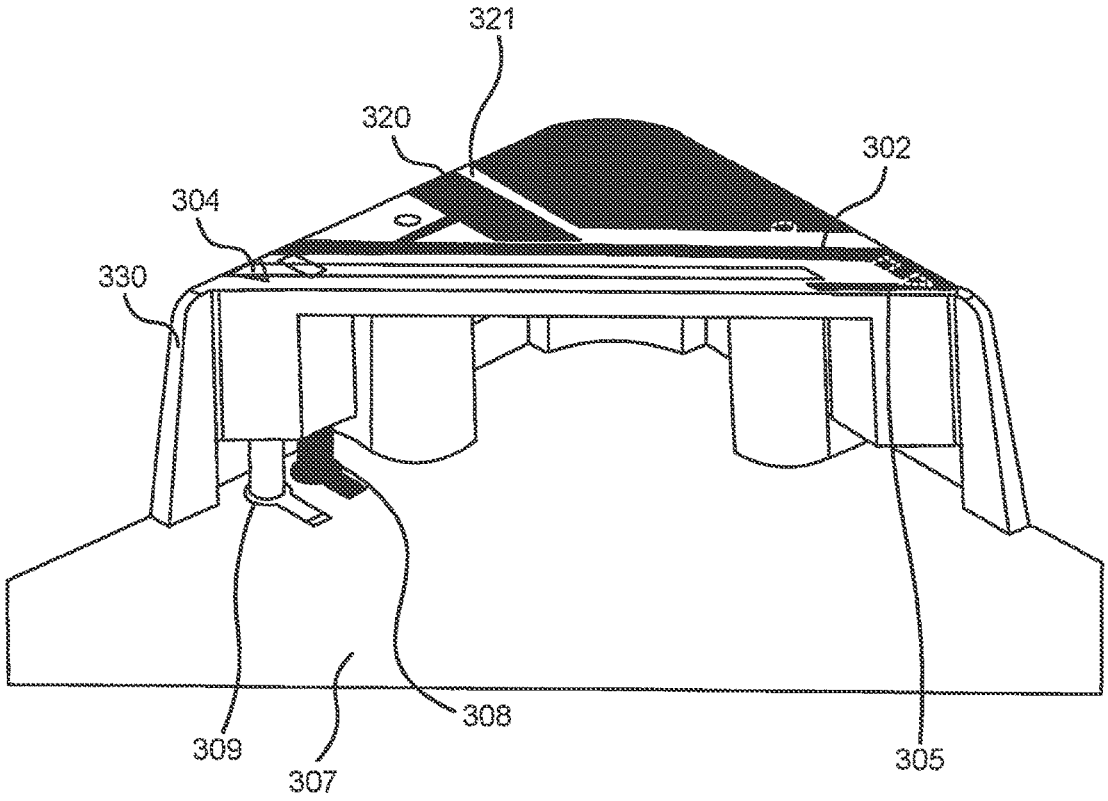
Figure 28:
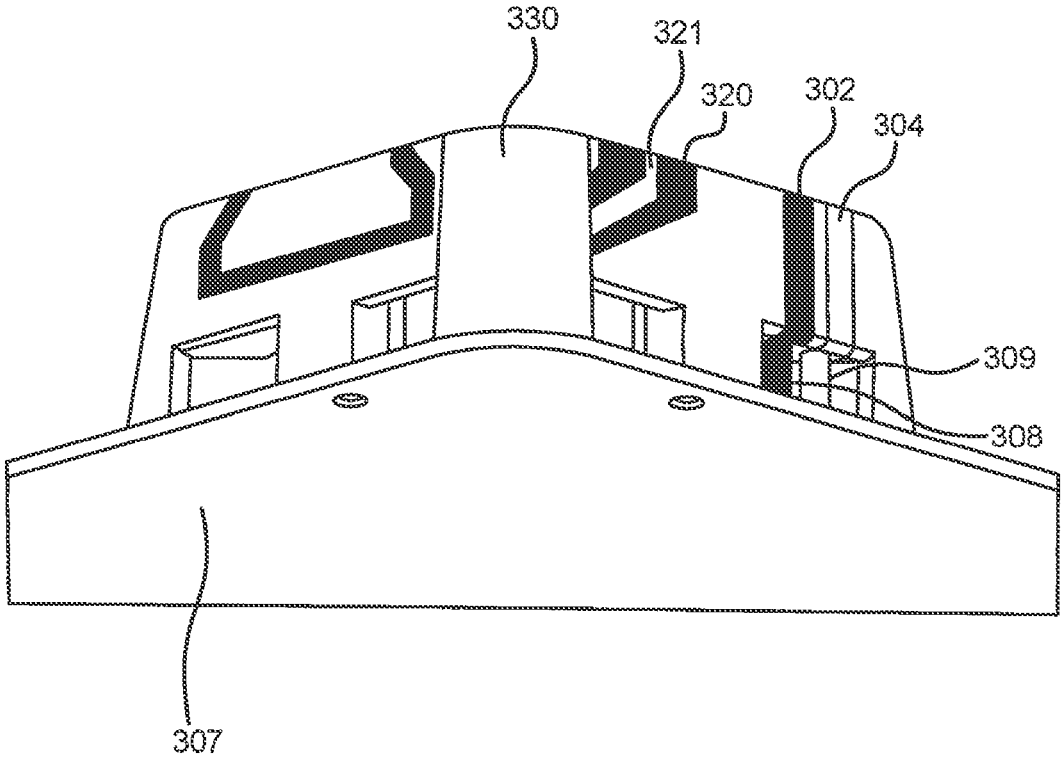

FIGS. 26 to 28 show alternative views of the antenna device of FIGS. 24 and 25 and casing.

Figure 29:
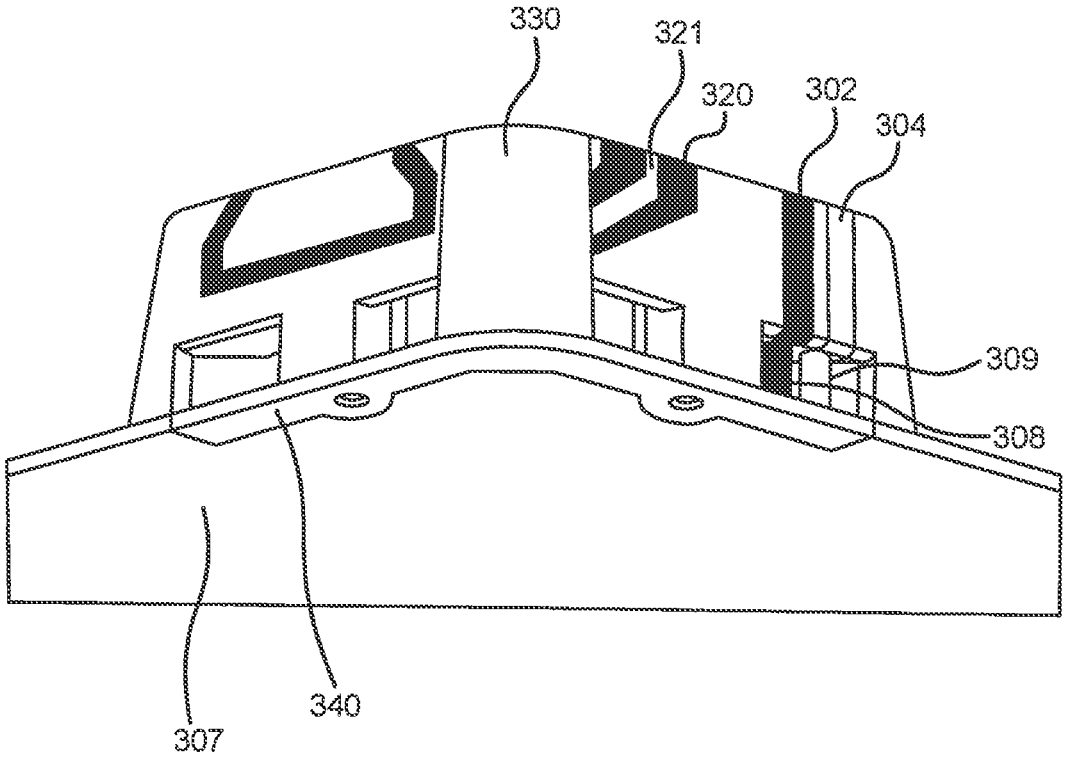

FIG. 29 shows a variation of the antenna device of FIGS. 24 to 28, where an portion of the groundplane or ground structure 307 is cleared at the corner where the antenna 302 and carrier 330 are located. This results in a L-shaped strip 340 at the corner of the PCB where no conductive groundplane is present. The L-shaped strip 340 is located underneath the carrier 330 and antenna 302, and helps to increase the bandwidth of the antenna.

It will be clear to a person skilled in the art that features described in relation to any of the embodiments described above can be applicable interchangeably between the different embodiments. The embodiments described above are examples to illustrate various features of the invention.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

In the context of the present disclosure, the expression "capacitively coupled" is used to denote the electromagnetic effect that occurs between two conductors separated by an insulator, so that when time variable electric charge distributions and electric currents are present in one conductor, the electromagnetic fields generated by such charge distributions and currents induce corresponding charge distributions and currents on the second conductor.

The invention claimed is:

1. A multiband antenna device comprising a conductive elongate antenna element configured for electrical connection to a ground plane at a grounding point, and a conductive elongate feeding element configured for electrical connection to a radio transmitter/receiver at a feeding point, wherein at least a major portion of the antenna element is configured to extend in a first direction along a first portion and to double back on itself forming a second portion that extends in a second direction substantially counter-parallel to the first direction prior to terminating at a first free end, the first portion and the second portion forming a first slot, wherein the feeding point is adjacent to the grounding point, and wherein the feeding element is configured to extend substantially parallel to the first and second directions of the major portion of the antenna element, wherein the antenna element is provided with a capacitive coupling branch separate from the second portion that extends from the first portion and runs substantially counter-parallel thereto prior to terminating at a second free end, thereby to define a second slot between the capacitive couple branch and the first portion, a portion of the feeding element positioned in the second slot and having opposing sides parallel to the first direction, the opposing sides being between and directly adjacent to the first portion and the capacitive coupling branch.

2. The device of claim 1, wherein the antenna element further includes a third portion that is for electrical connection to the ground plane at the grounding point and extends in a direction substantially perpendicular to an edge of the ground plane, wherein the first portion extends in the first direction substantially parallel to the edge of the ground plane, and wherein the second portion extends in the second direction substantially counter-parallel to the first direction.

3. The device of claim 1, wherein the feeding element is arranged to couple capacitively with the antenna element during operation of the antenna device.

4. The device of claim 1, wherein the antenna element is provided with a branch that extends from the first portion of the antenna element and away from the feeding element, the branch introducing an additional resonance having a higher frequency than a frequency of resonance provided by another portion of the antenna element.

5. The device of claim 1, wherein the feeding element comprises a first end for connection to the ground plane at the feeding, and a second end for connection to the ground plane at another position.

6. The device of claim 5, wherein the second end of the feeding element is provided with a complex impedance element for connection to the ground plane.

7. The device of claim 6, wherein the complex impedance element is an electronically controlled variable complex impedance element.

8. The device of claim 6, comprising an electronically controlled RF switch and a plurality of different complex impedance elements, the RF switch being controllable to commute between the different complex impedance elements.

9. The device of claim 1, wherein the antenna element is configured for electrical connection to the ground plane at the grounding point by way of a complex impedance element.

10. The device of claim 9, wherein the complex impedance element is an electronically controlled variable complex impedance element.

11. The device of claim 10, comprising an electronically controlled RF switch and a plurality of different complex impedance elements, the RF switch being controllable to commute between the different complex impedance elements.

12. The device of claim 1, wherein the antenna element and feeding element are formed as conductive tracks on a printed circuit board (PCB) having first and second opposed surfaces.

13. The device of claim 12, wherein the antenna element and the feeding element are formed on the same surface of the PCB.

14. The device of claim 12, wherein the antenna element is formed on the first surface of the PCB and the feeding element is formed on the second surface of the PCB.

15. The device of claim 12, wherein the PCB includes a conductive portion defining the ground plane.

16. The device of claim 12, wherein the PCB is configured as a separate daughterboard for connection to a motherboard including the ground plane.

17. The device of claim 1, wherein the antenna element and the feeding element are disposed on a dielectric former element configured for attachment to a PCB.

18. The device of claim 17, wherein antenna element and the feeding element are wrapped around the dielectric former element.

19. The device of claim 1, wherein the antenna element and optionally the feeding element have a bent or folded arrangement so as to conform around a corner of the ground plane.

* * * * *